US005409585A

United States Patent [19]

Essary et al.

[11] Patent Number: 5,409,585

[45] Date of Patent: Apr. 25, 1995

[54] NOZZLE ARRANGEMENT FOR ELECTROCOATING CONTAINER INTERIORS

[75] Inventors: William A. Essary, Saxonburg; Gerald R. Gacesa, Baden, both of Pa.

[73] Assignee: PPG Industries, Inc., Pittsburgh, Pa.

[21] Appl. No.: 43,082

[22] Filed: Apr. 5, 1993

[51] Int. Cl.[6] ..... C25D 13/00

[52] U.S. Cl. ..... 204/180.7; 204/299 EC

[58] Field of Search ..... 204/180.7, 299 EC, 300 EC; 118/627, 629

[56] References Cited

U.S. PATENT DOCUMENTS

| | | | |
|---|---|---|---|
| 1,150,376 | 8/1915 | Leonard et al. | 239/489 |
| 1,309,596 | 7/1919 | Parker | 239/489 |
| 1,315,765 | 9/1919 | Eckart | 239/402 |
| 3,743,187 | 7/1973 | Breunsbach | 239/489 |
| 3,922,213 | 11/1975 | Smith et al. | 204/180.7 |
| 3,952,698 | 4/1976 | Beyer et al. | 118/314 |
| 4,094,760 | 6/1978 | Smith et al. | 204/180.7 |
| 4,107,016 | 8/1978 | Brower, Jr. et al. | 204/180.7 |
| 4,119,522 | 10/1978 | Brower, Jr. et al. | 204/300 EC |
| 4,210,507 | 7/1980 | Davidson et al. | 204/180.7 |
| 4,246,088 | 1/1981 | Murphy et al. | 204/181.1 |
| 4,400,251 | 8/1983 | Heffner et al. | 204/180.7 |
| 4,436,594 | 3/1984 | Nishida et al. | 205/211 |
| 4,515,677 | 5/1985 | Heathcoat et al. | 204/300 EC |
| 4,883,578 | 11/1989 | Jowitt et al. | 204/300 EC |
| 5,164,056 | 11/1992 | Loeck | 204/299 EC |

FOREIGN PATENT DOCUMENTS 2318948 2/1977 France .

OTHER PUBLICATIONS

Patent Abstract of Japan, vol. 4, No. 81 (C-14) (563) 11 Jun. 1980 & JP,A,55 044 544 (Matsuhita Denki Sangyo KK) 28 Mar. 1990.

*Primary Examiner*—John Niebling
*Assistant Examiner*—Brendan Mee
*Attorney, Agent, or Firm*—Dennis G. Millman

[57] ABSTRACT

In an apparatus and method for electrocoating containers such as metal cans, continuity of liquid coating material with the inverted interiors of the containers is improved by partially blocking the flow of liquid from the containers by baffle means.

11 Claims, 1 Drawing Sheet

NOZZLE ARRANGEMENT FOR ELECTROCOATING CONTAINER INTERIORS

BACKGROUND OF THE INVENTION

This invention relates to electrocoating surfaces of interior cavities of articles such as containers for foods and beverages, particularly metal cans. In electrocoating, an electric circuit is established between the surface being coated and the coating source so that the coating is ionically attracted to the surface. When the electrocoating process involves spraying the coating, it is important that the sprayed stream provide a continuous conductive connection between the spray nozzle and the surface being coated.

It has been known to electrocoat the interiors of containers by means of a spray nozzle which is inserted into the cavity. Examples of this approach may be seen in U.S. Pat. Nos. 3,922,213; 4,119,522; 4,094,760; 4,107,016; 4,210,507; 4,246,088; 4,400,251; 4,436,594; 4,515,677; and 4,883,578. With a nozzle inserted into the cavity, particularly if the nozzle body fills a substantial portion of the space in the cavity, maintaining continuity of liquid contact can be relatively easy. However, a drawback to that approach is that inserting and withdrawing the nozzle from each container limits the speed with which the containers can be processed. Nevertheless, that approach had been commonly proposed as the preferred method for electrocoating containers such as cans.

Avoiding inserting spray nozzles into each container has the potential for increased production line speeds, and such an arrangement is shown in U.S. Pat. No. 5,164,056. In that arrangement, the containers, with their open ends oriented generally downwardly, are supported on an open grate while the coating is sprayed upwardly into the interior cavities of the container from nozzles located within or below the grate. While this arrangement shows considerable potential for improved electrocoating line speeds, maintaining continuity of contact between the coating liquid and the interior surface of the container during electrocoating can be difficult since the spray nozzles are distant from the farthest extremity of the interior surface and there is considerable open space within the cavity. If flow of the liquid coating does not uniformly cover the surface to be coated during the electrocoating stage, the resulting coating layer will be of non-uniform thickness and in some areas may be of inadequate thickness.

In U.S. Pat. No. 5,164,056 it is suggested that uniform coverage of the interior of the container may be aided by using spiral shapes within the spray nozzles and by aligning the nozzles so that more than one nozzle directs coating into the interior at any given time. Further improvements would be desirable. It may also be possible to improve the filling of the interior by using high flow rates, but this approach can be uneconomical due to the large pumping requirements that are entailed. High pumping rates can also lead to the detrimental side effect of foaming. Coating flow pressures that are unduly high can be a problem in the arrangement of U.S. Pat. No. 5,164,056 in that tile containers can be lifted momentarily from the support means unless held down to close tolerances, which if not carefully maintained can result in containers being damaged by the conveying means. Metal cans that are not strengthened at the neck (such as by a narrowed neck portion) are particularly susceptible to being damaged in this way. In other arrangements, lifting of the container may break electrical contact which is required for electrocoating.

The problem of providing complete contact of the interior of the container with liquid coating material is particularly acute with metal cans that are straight-walled, i.e., not having a narrowed neck portion.

SUMMARY OF THE INVENTION

By this invention uniformity of contact between a liquid coating stream and the interior of a container cavity is improved in an electrocoating process by baffle means that block flow from the inverted container. The baffle reduces the rate at which the liquid coating flows from the container, thereby assuring that the cavity within the container is filled with the liquid for a period of time sufficient to uniformly electrocoat the surface of the cavity. Not only does the baffle regulate the flow of coating from the container, but also inhibits entrainment of air into the container. Although not wishing to be bound by theory, it is believed that entrainment and/or entrapment of air within the container was a significant cause of coating non-uniformity in the prior art. By restricting the outflow of coating from the container, the container substantially fills with liquid and air may be displaced.

The baffle or baffles may be located close to the discharge end of at least one coating nozzle, adjacent to the open end of the container cavity. In other words, the open area between the nozzle and the rim of the container cavity is to be reduced by the presence of the baffle. In order for there to be an appreciable effect, at least 25 percent of the area of the flow path between the nozzle and the container lip will be blocked by the baffle. Preferably, at least 50 percent of the flow path is blocked by the baffle, more preferably at least 60 percent. Although not necessary for the broader aspects of the invention, additional benefits are believed to be attained by the mounting a baffle in abutting relationship to a nozzle so as to block the flow of entrained air adjacent to the nozzle.

It is particularly advantageous that the present invention permits straight-walled containers to be fully covered with liquid coating material during electrocoating. Improvements may also be obtained with containers having necked-down openings.

THE DRAWING

FIG. 1 is a cross-sectional view of an embodiment of a container electrocoating station incorporating the features of present invention, showing a single can in position for receiving a coating.

DETAILED DESCRIPTION

Figure 1:
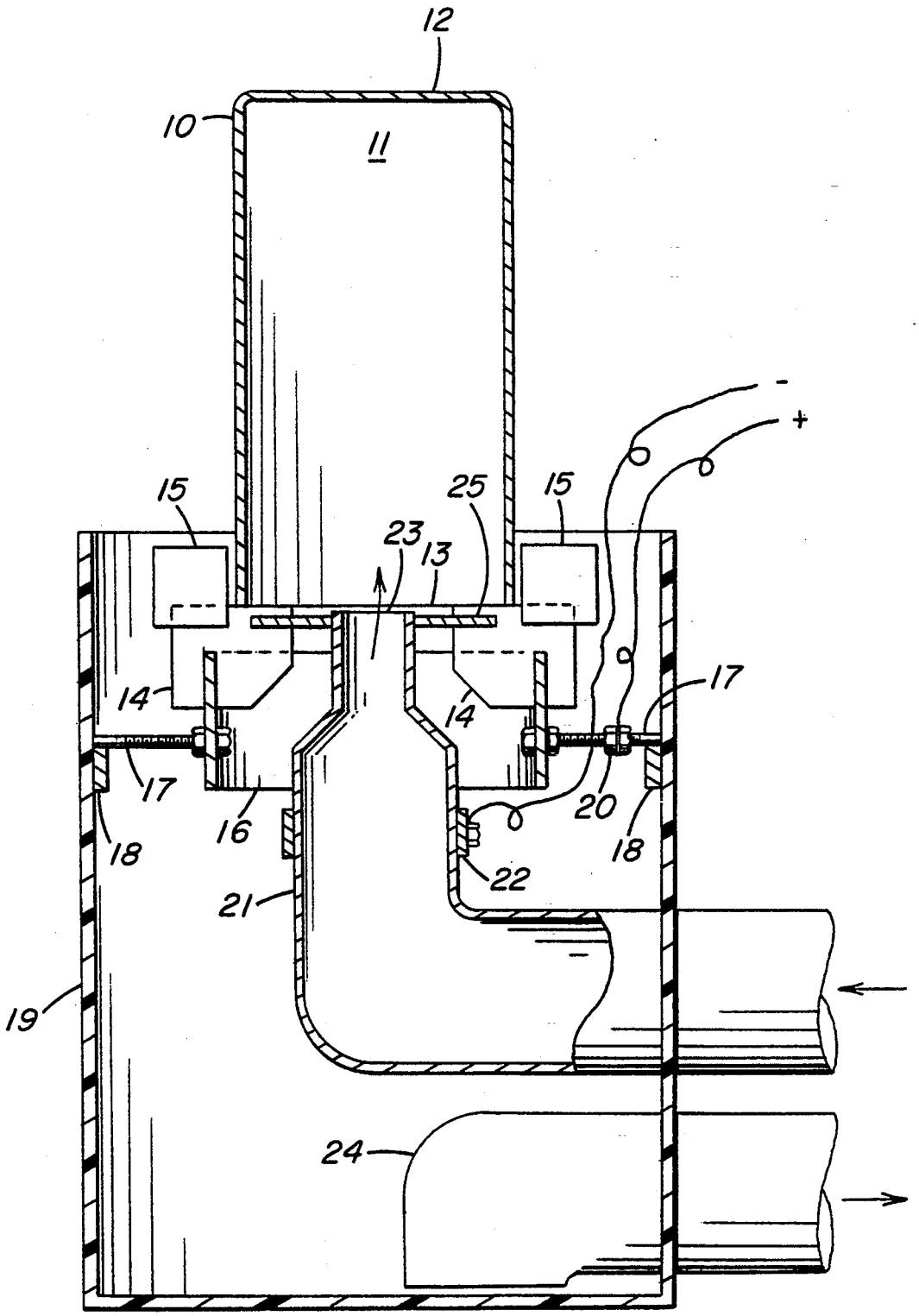

The embodiment of FIG. 1 is adapted to coat the interior of a container such as a metallic beverage can, which may typically be aluminum or steel. It should be understood that the container could be a variety of shapes and sizes and need not be limited to cans. The material from which the container is made need not be metal, although it should be sufficiently electroconductive to be compatible with the electrocoating process. In the particular arrangement of FIG. 1 a can 10 having an interior cavity 11, a closed end 12, and a substantially open opposite end terminating in a rim 13 is shown in the inverted position ready for coating. The rim 13 of the can may be straight as shown or it may be necked down (i.e., with a reduced diameter at the open end).

The can 10 is positioned in the coating station of the FIG. 1 embodiment in an inverted orientation with the open end facing substantially downwardly. In this position, the rim 13 of the can rests on the upper edges of vertically aligned support plates 14, of which there are at least three. In this arrangement, electrical contact with the can 10 is made by way of the support plates 14. Therefore, the support plates 14 are electroconductive, but other means could be used to provide electrical contact with the can. For the sake of horizontally aligning the can in the coating position, locator blocks 15 may be carried on the upper edges of the support plates 14.

The support plates 14 may conveniently be carried on a ring 16 as shown in FIG. 1, and the ring 16 may also be metallic so as to conduct electric current to the support plates. The ring 16 may, in turn, be supported by threaded rods 17 attached to the ring and extending radially therefrom, whereby the rods 17 may rest upon tabs 18 affixed to the inside of a tank 19. The tank 19 is preferably non-electroconductive or it may be electrically isolated from the electrically energized components. As shown in the drawing, an electrical connection may be made to the ring 16 and the support plates 14 by way of one of the threaded rods 18 at nuts 20. The electrocoating process may be anodic or cathodic, and in the case of anodic electrodeposition as depicted, the connection at 20 is made to the anode of a direct current source. The other pole of the direct current source may be connected to a spray nozzle conduit 21, for example by a ring clamp connector 22. For this purpose, the nozzle conduit is preferably electroconductive (e.g., metal), although the portion of the conduit below the clamp connector 22 may be non-conductive (e.g., plastic).

Nozzle conduit 21 terminates in a spray tip 23 oriented to direct a stream of liquid coating into the interior cavity 11 of the can 10. A specialized spray tip configuration, such as spiral flow means, has not been found to be necessary with the present invention, although that and other types of flow modifying nozzles may be used and may be of benefit in some situations. The liquid coating material is supplied to the nozzle by a standard coating spray pump system (not shown). After having been directed into the interior of the can, excess liquid coating material flows from the can and gathers in the tank 19, from which it is returned to the pump system through a drain conduit 24. For the purpose of clarity, the liquid coating material is not shown in the drawing.

The structural details of the electrocoating station of FIG. 1 described above are not critical to the present invention, which may encompass a wide variety of support and conveying systems for cans or other containers. In particular, the invention is adaptable to continuous coating arrangements such as that shown in U.S. Pat. No. 5,164,056 wherein the cans are moved along support blades over a plurality of coating nozzles. Another type of conveying and coating system that may lend itself to the improvements of the present invention is shown in U.S. Pat. No. 3,952,698 in which a mesh conveyor carries cans through a coating station. Characteristic of electrocoating systems that may benefit from the present invention are those in which the spray nozzle or nozzles do not substantially enter the cavity of the container, but rather direct liquid coating material into a generally inverted cavity from a location generally outside the cavity. The term "inverted" is used herein to include vertical orientations as well sloped orientations adapted to permit liquid to flow by gravity from the cavity as liquid is being sprayed into the cavity.

Referring again to the particular embodiment of the invention depicted in FIG. 1, a novel feature of the present invention is the provision of a baffle 25 near the rim 13 of the can 10. The baffle 25 extends across the open end of the can 10 so as to substantially reduce the area of the path through which liquid coating can flow from the cavity 11. In this embodiment, the baffle 24 is annular in shape and is carried on the spray nozzle 23, with notches cut for the support plates 14 to pass through. Providing the baffle in an abutting relationship to the nozzle is preferred since it is believed that air entrainment along the sides of the nozzle is reduced. Alternatively, the baffle could be carried by other structural elements of the coating station, and rather than extending outwardly from the nozzle the baffle could extend inwardly toward the nozzle with an open area adjacent to the nozzle. It is also contemplated that the baffle could have a plurality of openings and may comprise a foraminous member. The baffle may also be made up of a plurality of pieces which may, for example,have gaps therebetween .constituting the opening. The shape of the baffle and the opening or openings may vary considerably as long as a substantial portion of the open end of the container is blocked. The baffle, as well as the spray nozzle, are preferably located below the elevation at which the container is supported, since it is desired to avoid the time delay caused by insertion and withdrawal of coating means from the interiors of the containers.

The extent to which the open end should be blocked depends upon factors such as the nozzle size, pump pressure, coating viscosity, and container configuration. For an appreciable effect in a typical case, at least 25 percent of the area of the opening will be blocked, preferably at least 50 percent, most preferably 60 percent. The area of blockage may be taken as the difference between the area available for drainage of liquid from the cavity 11 without the baffle and with the baffle. The area available for drainage is essentially the area of the opening at the mouth of the container minus the area obstructed by the nozzle and any baffle. Vertical spacing between the rim of the container and the baffle may also be taken into account when calculating these areas. For example, the baffle may have the same or even larger area than the container opening with a vertical space therebetween, whereby the opening that remains is in the vertical dimension (i.e., a cylindrical opening). In the nozzle-supported, annular baffle arrangement shown in FIG. 1, the space between the container rim and the baffle will typically have both vertical and horizontal components, which are to be taken into account when calculating the area of blockage. Obviously the flow path for escaping liquid should not be totally blocked, but in some cases it is possible for the area of the opening that remains to be a very small. Thus, there is no limit established for the maximum area of the flow path that may be blocked by the baffle, but blocking as much as 99 percent of the area may be suitable in some cases.

In embodiments that include a plurality of spray nozzles, there may likewise be included a plurality of baffles. In such a case, the baffles may each be carried on a nozzle as in FIG. 1, or the baffles may be located between adjacent nozzles. As containers are conveyed horizontally past a series of nozzles and baffles, the area of the container opening that is effectively blocked may be constantly changing, which is acceptable provided that the average degree of blockage of each container as it passes through the electrocoating station meets the requirements of the present invention. A more constant blockage may be attained in the case of containers being conveyed over a series of spray nozzles by providing the baffle in the form of a continuous strip parallel to the direction of conveyance.

The use of flexible polymeric materials as the baffle has shown some advantage because the ability of such a baffle to bend and thereby temporarily enlarge the opening is believed to create a self-regulating effect when excessive pressure is created in the cavity 11. However, it is also suitable for the baffle to be fabricated from rigid materials, although the baffle is preferably not made of electroconductive material in order to avoid arcing between the container being coated and the nozzle.

When an inverted container such as a metal can is substantially filled with liquid coating material, the weight of the liquid within the container contributes to the apparent weight of the container, thereby helping to prevent the container from lifting from its support in the electrocoating station. Excessive coating spray pressure, however, may cause the containers to lift, in which case it may be desirable to provide hold-down means above the containers to retain them in place during electrocoating. A hold-down rod such as shown in U.S. Pat. No. 5,164,056 would be suitable.

It is considered desirable to displace any entrapped air from the upper end of the inverted container during electrocoating, but since the container will be substantially full of liquid during electrocoating when operating in accordance with the present invention, it is preferred that the coating stream be of sufficient force to penetrate through the volume of liquid substantially to the closed end of the container. The combination of the requirement for sufficient flow volume to keep the container filled and sufficient flow velocity to penetrate through the body of liquid will determine the appropriate combination of nozzle configuration and pumping rate.

The present invention can yield improvements for electrocoating cans that are either straight-walled or necked-down at the rim, but the improvements are particularly significant for straight-walled cans.

The present invention has been described with reference to specific embodiments for the sake of disclosing the preferred mode of carrying out the invention, but it should be understood that other variations and modification may be resorted to without departing from the scope of the invention as defined by the claims that follow.

We claim:

1. Apparatus for electrocoating interior surfaces of an article having a cavity with an open end terminating in a rim comprising:

means for supporting the article with the rim at a support elevation and with the open end oriented downwardly;

nozzle means positioned at or below the support elevation adapted to discharge coating material upwardly into the cavity from outside the cavity with a space between the nozzle and the rim defining a flow path for coating material to flow from the cavity;

the improvement comprising a baffle in the space blocking at least 25 percent of the flow path, whereby flow of coating material from the cavity is retarded.

2. The apparatus of claim 1 wherein the baffle blocks at least 50 percent of the flow path.

3. The apparatus of claim 1 wherein the baffle blocks at least 60 percent of the flow path.

4. The apparatus of claim 1 wherein the baffle is carried on the nozzle.

5. The apparatus of claim 1 wherein the baffle is a flexible polymeric material.

6. The apparatus of claim 1 wherein the nozzle is directed in a longitudinal direction and the baffle extends transversely thereto.

7. A method for electrocoating interior surfaces of an article having a cavity with an open end terminating in a rim comprising:

supporting the article with the rim at a support elevation and with the open end oriented downwardly;

discharging coating material upwardly into the cavity from nozzle means positioned substantially outside the cavity and permitting the discharged coating material to drain from the cavity through a flow path between the nozzle and the rim;

the improvement comprising blocking at least 25 percent of the flow path by means of a baffle, whereby flow of coating material from the cavity is retarded.

8. The method of claim 7 wherein the article is a metal container.

9. The method of claim 8 wherein the container is a can.

10. The method of claim 9 wherein the can is straight-walled.

11. The method of claim 7 wherein the article is in electrical contact with an anode of a direct current electrical source.

* * * * *